US007102255B2

(12) United States Patent
Kwatra et al.

(10) Patent No.: US 7,102,255 B2
(45) Date of Patent: Sep. 5, 2006

(54) SOFT POWER-UP FOR AN EXTERNAL POWER ADAPTER

(75) Inventors: Ajay Kwatra, Austin, TX (US); Robert Allen, Cedar Park, TX (US); Kwabena Asante, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/373,397

(22) Filed: Feb. 24, 2003

(65) Prior Publication Data

US 2004/0164721 A1 Aug. 26, 2004

(51) Int. Cl.
*H01H 3/00* (2006.01)

(52) U.S. Cl. ..... 307/140; 307/149; 320/114; 320/128; 439/913

(58) Field of Classification Search ..... 307/116, 307/125, 149, 132 M, 150, 147, 131, 140, 307/126, 38, 115; 361/179, 181, 826, 679, 361/736, 562, 737; 323/283, 222; 710/303, 710/304; 702/60, 62, 65, 120, 183; 439/911, 439/913; 320/114, 128
See application file for complete search history.

(56) References Cited

U.S. PATENT DOCUMENTS 4,812,847 A * 3/1989 Stewart et al. ..... 341/154
5,463,261 A * 10/1995 Skarda et al. ..... 307/131
5,719,450 A * 2/1998 Vora ..... 307/116
5,855,064 A 1/1999 Chang ..... 29/861
6,000,042 A * 12/1999 Henrie ..... 714/40
6,178,514 B1 * 1/2001 Wood ..... 713/300
6,210,036 B1 * 4/2001 Eberle et al. ..... 374/141
6,314,001 B1 11/2001 Chu ..... 361/826
6,333,668 B1 12/2001 Takashima ..... 327/538
6,407,959 B1 6/2002 Ishikawa et al. ..... 365/226
6,459,175 B1 * 10/2002 Potega ..... 307/149
6,597,565 B1 * 7/2003 Kluth et al. ..... 361/679

* cited by examiner

*Primary Examiner*—Rajnikant B. Patel

(57) ABSTRACT

An external power adapter prevents damage to contacts of power connectors by reducing current in-rush when the powered-up external power adapter is coupled to an information handling system. A control signal from the information handling system is used to initiate a voltage output of the external power adapter such that substantially no voltage is present on the contacts of the power connectors until the control signal is detected by the external power adapter. The external power adapter may determine the presence of an electrical load before applying the output voltage to the information handling system. The output voltage may be ramped from substantially no voltage to operating voltage over a period of time.

11 Claims, 9 Drawing Sheets

SOFT POWER-UP FOR AN EXTERNAL POWER ADAPTER

BACKGROUND OF THE INVENTION TECHNOLOGY

1. Field Of The Invention

The present invention is related to information handling systems, and more specifically, to external power adapters for the information handling systems.

2. Description Of The Related Art

As the value and use of information continues to increase, individuals and businesses seek additional ways to process and store information. One option available to users is information handling systems. An information handling system generally processes, compiles, stores, and/or communicates information or data for business, personal, or other purposes, thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems, e.g., computer, personal computer workstation, portable computer, computer server, print server, network router, network hub, network switch, storage area network disk array, RAID disk system and telecommunications switch.

Many of these information handling systems use external power adapters to reduce size, weight, cost and heat generation, and to add more flexibility in adapting to different voltages and electric receptacle configurations in various countries throughout the world. However, as the information handling systems increase in sophistication and information handling abilities, more power is required and must be filtered accordingly for robustness of the information handling system integrity. As such, the information handling systems may have a very significant current inrush caused by large capacitance filters associated with the power input to the information handling system. If the external power adapter is connected to a power source (e.g., plugged into a wall electrical outlet) before being connected to the power input of the information handling system, a substantial amount of current occurs due to the charging requirements of the large filter capacitance (e.g., in-rush current).

The power input of the information handling system and the power output of the external power adapter comprise mating connector contacts which may be substantial damaged due to the high in-rush current. Presently, oversized connector contacts must be used to insure that mating of the external power adapter output connector with the information handling system power input connector can survive such misuse by the user. Oversized connector contacts add addition cost, weight and size to the information handling system, and may over time and repeated misuse still fail due to arcing and pitting of the contacts from repeated high in-rush current.

Therefore, what is needed is a solution for preventing damage to the power connector contacts of the information handling system and its external power adapter by user actions.

SUMMARY OF THE INVENTION

The present invention remedies the shortcomings of the prior art by providing for a soft power-up when an external power adapter output connector is coupled to an input power connector of an information handling system. This soft power-up substantially eliminates destructive in-rush current that otherwise would damage the contacts of the mating power connectors.

In an exemplary embodiment of the present invention, a control signal from the information handling system signals the external power adapter to turn power on after the mating power connectors are coupled together. An additional feature for this exemplary embodiment is having the power connections engage before the control signal connection engages, and disengaging the control signal connection before the power connections disengage. Still an additional feature, upon detection of the control signal, the external power adapter may gradually increase voltage so as to gradually charge-up the filter capacitance of the information handling system.

In still another exemplary embodiment of the present invention, an external power adapter senses when a load is connected to its output and, when detected, gradually increases its output voltage so as to charge-up the filter capacitance of the recently connected information handling system. This embodiment may be configured to replace existing power adapters having only two contacts, e.g., a coaxial female plug since no additional signal contacts are required to initiate the voltage ramping operation thereof.

A technical advantage of the present invention is prevention of contact erosion due to high in-rush current. Another technical advantage is reduced surge current when a power adapter is connected to equipment. Still another technical advantage is controlled charging of equipment filter capacitance. Other technical advantages should be apparent to one of ordinary skill in the art in view of what has been disclosed herein.

BRIEF DESCRIPTION OF THE DRAWINGS

A more complete understanding of the present disclosure and advantages thereof may be acquired by referring to the following description taken in conjunction with the accompanying drawings wherein.

Figure 1:
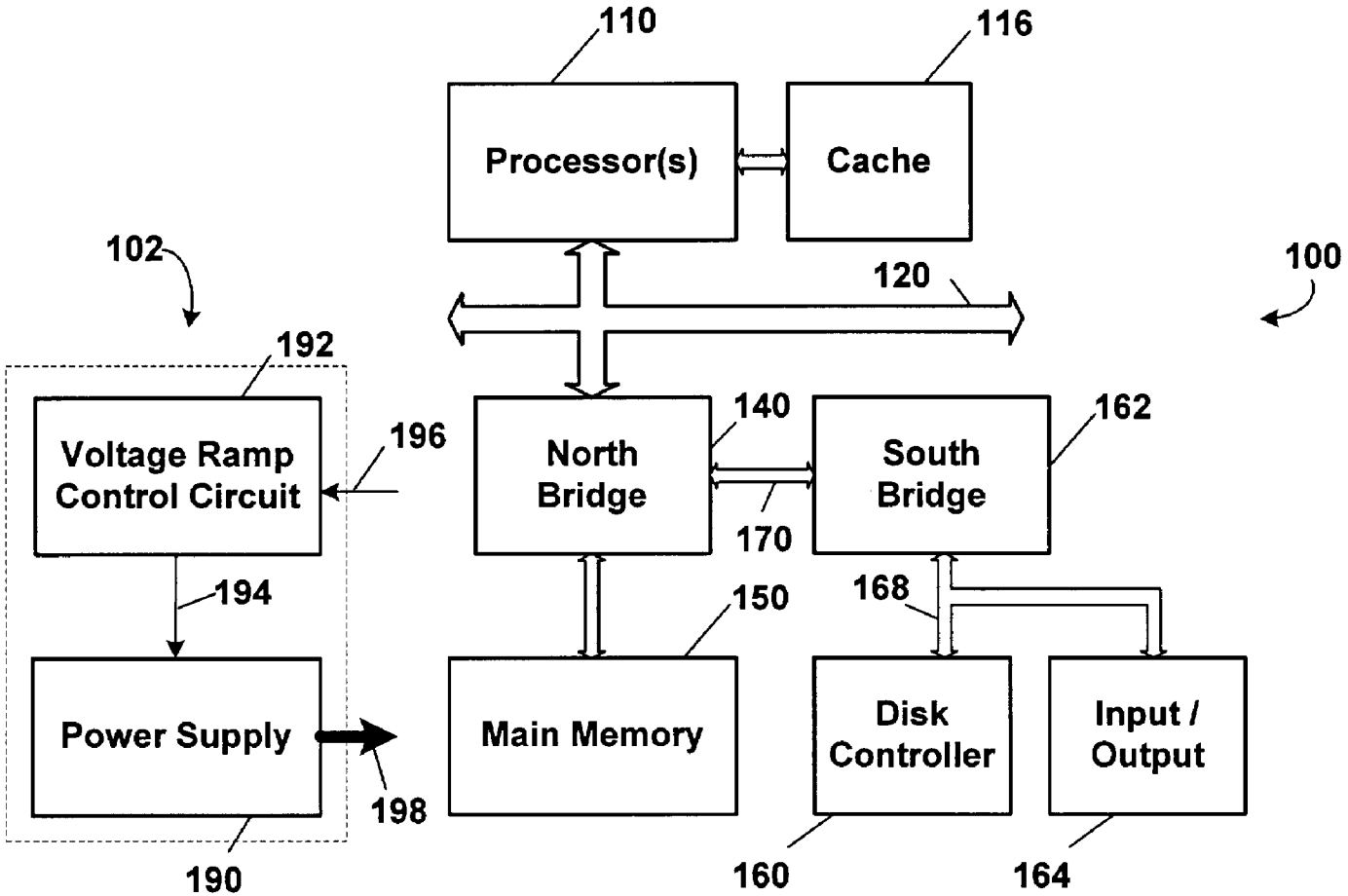
FIG. 1 is a schematic block diagram of an exemplary embodiment of an information handling system and an exemplary embodiment of the present invention.

The present invention may be susceptible to various modifications and alternative forms. Specific exemplary embodiments thereof are shown by way of example in the drawing and are described herein in detail. It should be understood, however, that the description set forth herein of specific embodiments is not intended to limit the present invention to the particular forms disclosed. Rather, all modifications, alternatives, and equivalents falling within the spirit and scope of the invention as defined by the appended claims are intended to be covered.

DETAILED DESCRIPTION OF SPECIFIC EMBODIMENTS

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU), hardware or software control logic, read only memory (ROM), and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Referring now to the drawings, the details of an exemplary embodiments of the present invention are schematically illustrated. Like elements in the drawings will be represented by like numbers, and similar elements will be represented by like numbers with a different lower case letter suffix.

Referring to FIG. 1, an information handling system is illustrated having electronic components mounted on at least one printed circuit board (PCB) (motherboard) and communicating data and control signals therebetween over signal buses. In one embodiment, the information handling system is a computer system. The information handling system, generally referenced by the numeral 100, comprises a processor(s) 110 coupled to a host bus(es) 120 and a cache memory 116. A north bridge(s) 140, which may also be referred to as a memory controller hub or a memory controller, is coupled to a main system memory 150. The north bridge 140 is coupled to the system processor(s) 110 via the host bus(es) 120. The north bridge 140 is generally considered an application specific chip set that provides connectivity to various buses, and integrates other system functions such as a memory interface. For example, an Intel 820E and/or 815E chip set, available from the Intel Corporation of Santa Clara, Calif., provides at least a portion of the north bridge 140. The chip set may also be packaged as an application specific integrated circuit (ASIC). The north bridge 140 typically includes functionality to couple the main system memory 150 to other devices within the information handling system 100. Thus, memory controller functions such as main memory control functions typically reside in the north bridge 140. In addition, the north bridge 140 provides bus control to handle transfers between the host bus 120 and a second bus(es), e.g., PCI bus 170, AGP bus coupled to graphics display (not shown), etc. A second bus(es) 168 may also comprise other industry standard buses or proprietary buses, e.g., ISA, SCSI, USB buses through a south bridge(s) (bus interface) 162. These secondary buses 168 may have their own interfaces and controllers, e.g., ATA disk controller 160 and input/output interface(s) 164, and interface with a disk controller, a network interface card, a graphics controller, a hard disk and the like.

In the information handling system 100, according to the present invention, an external power adapter 102 is coupled to and powers the information handling system 100. Power is supplied to the information handling system 100 through a power bus 198 having a connector (not shown) adapted to couple with a mating power connector on the information handling system 100. A control signal 196 indicates when the information handling system 100 is coupled to the power adapter 102.

Figure 2:
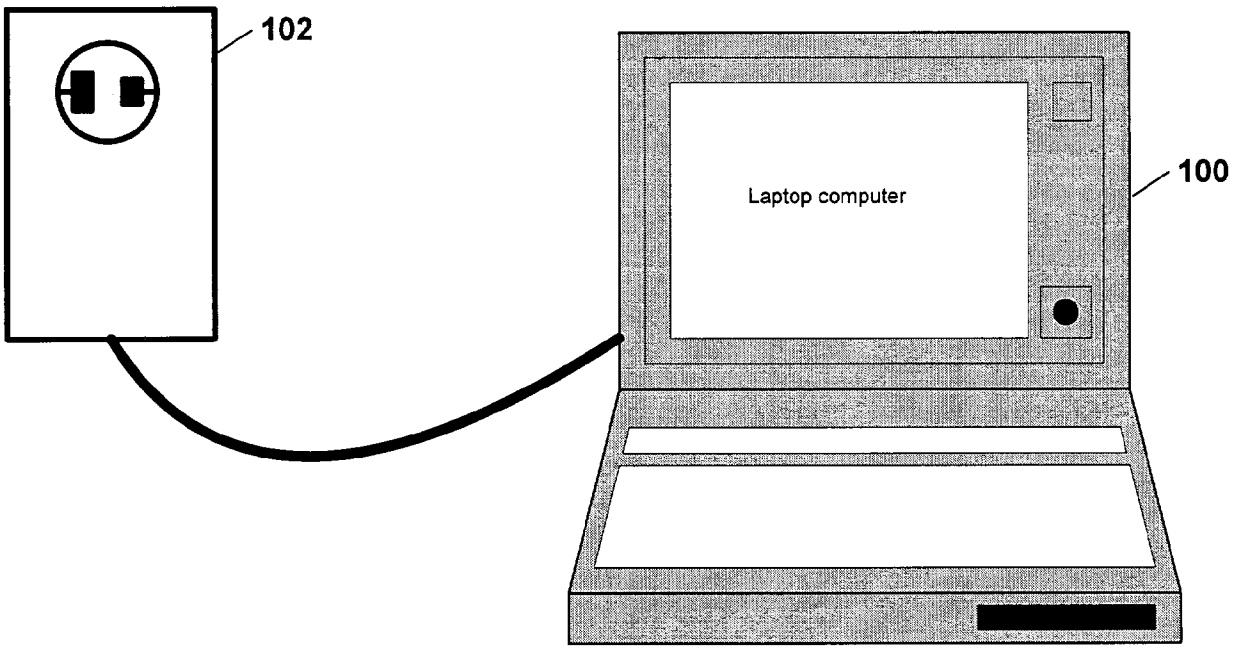
FIG. 2 is a schematic block diagram of a portable computer representing the equipment depicted in FIG. 1.

Referring to FIG. 2, depicted is an exemplary embodiment of an information handling system 100, e.g., a laptop computer, and an external power adapter 102, according to the present invention. The external power adapter 102 is configured to plug into an electrical outlet (not shown) and has a power cable with a power connector configured to plug into the information handling system 100.

Figure 2A:
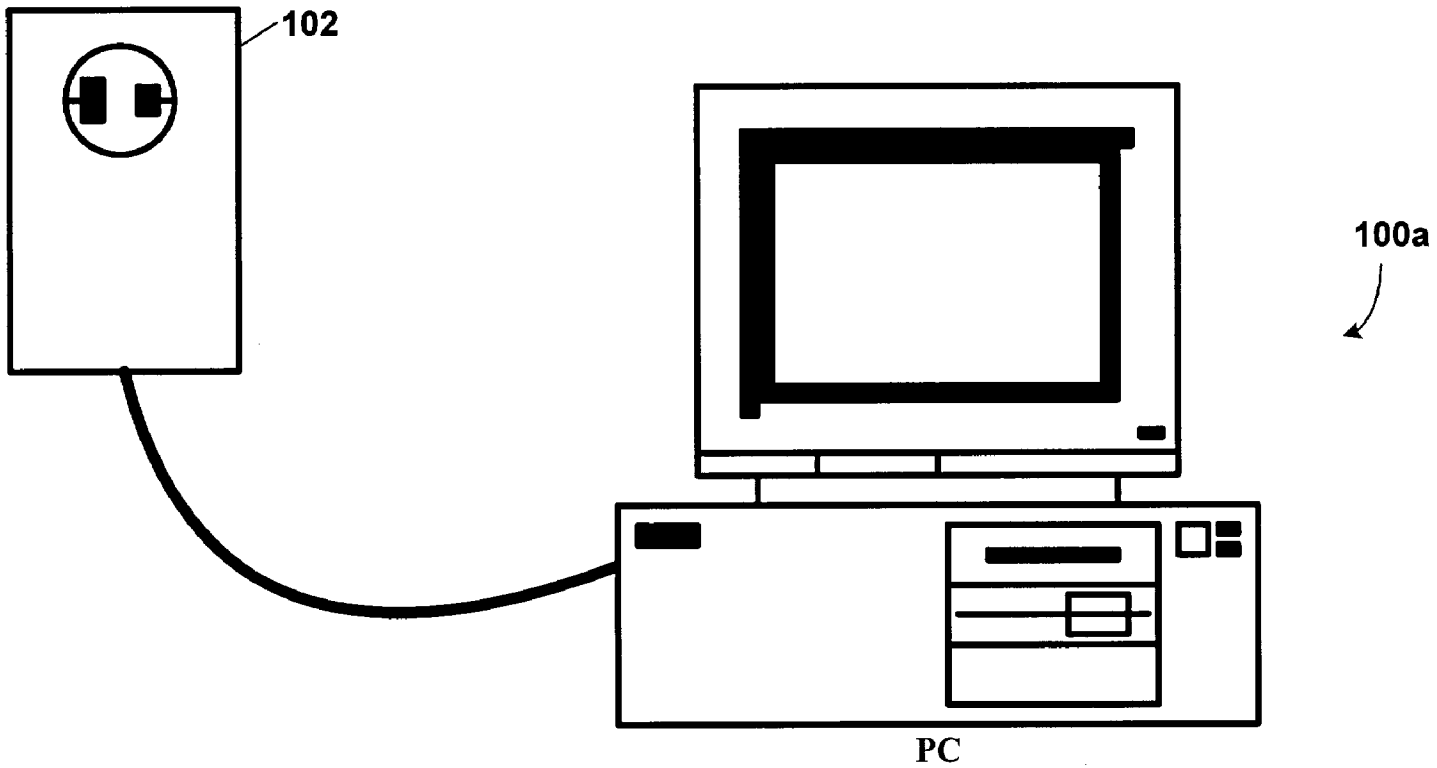
FIG. 2A is a schematic block diagram of a desk personal computer representing the equipment depicted in FIG. 1.

Referring to FIG. 2A, depicted is an exemplary embodiment of an information handling system 100*a*, e.g., a personal computer, and an external power adapter 102, according to the present invention. The external power adapter 102 is configured to plug into an electrical outlet (not shown) and has a power cable with a power connector configured to plug into the information handling system 100*a*.

Figure 2B:
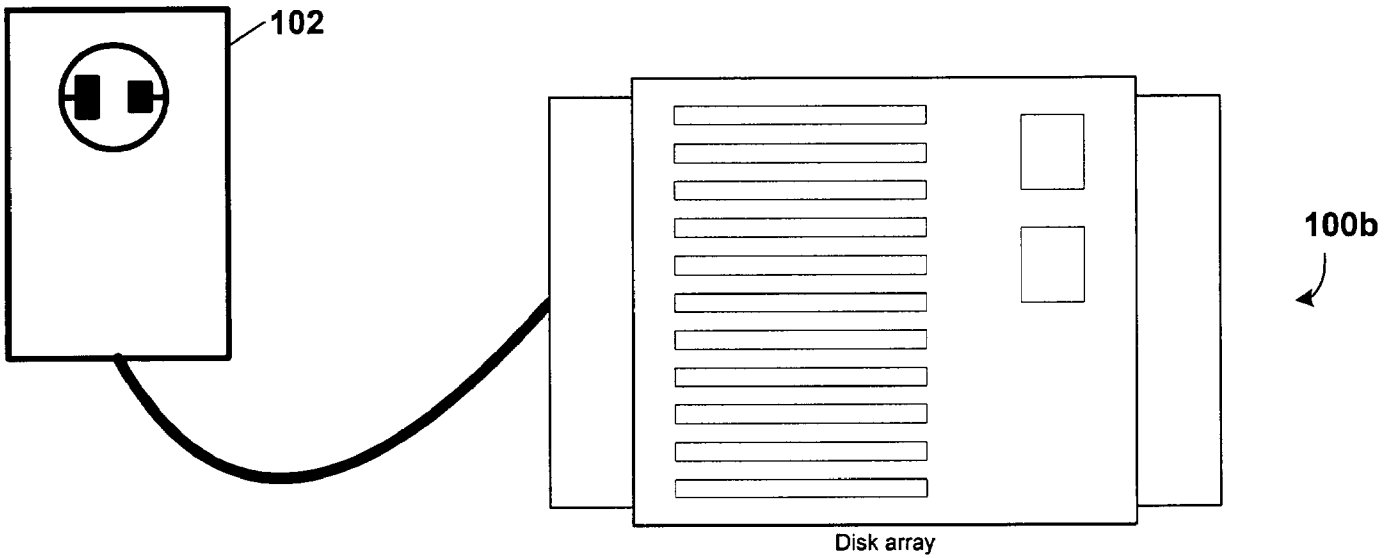
FIG. 2B is a schematic block diagram of a disk array representing the equipment depicted in FIG. 1.

Referring to FIG. 2B, depicted is an exemplary embodiment of an information handling system 100*b*, e.g., a disk array, and an external power adapter 102, according to the present invention. The external power adapter 102 is configured to plug into an electrical outlet (not shown) and has a power cable with a power connector configured to plug into the information handling system 100*b*. The information handling system 100*b* may also comprise, but be not limited to, a printer, a router, a communications hub, a switch, a bridge, a digital telephone controller (e.g., PBX/PABX), an answering machine, a modem, a tape drive, a scanner, a telephone, a facsimile machine, a plotter, an external removable storage drive (e.g., zip drive, CD-ROM, DVD, floppy, etc.) and the like.

Figure 3:
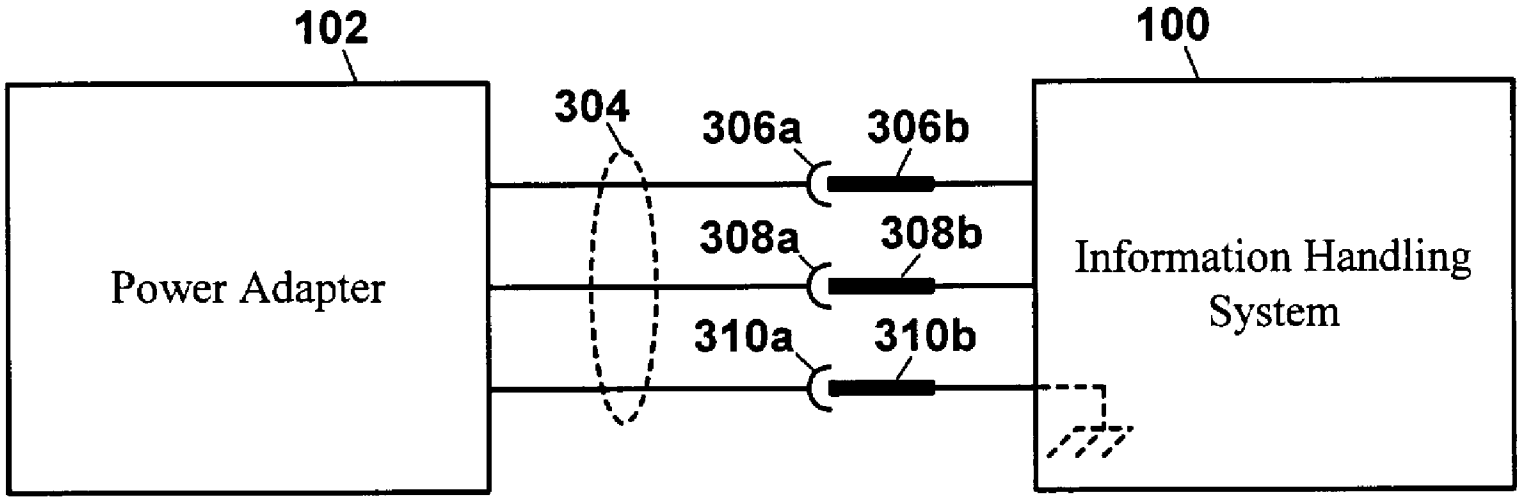
FIG. 3 is a schematic diagram of a connector according to an exemplary implementation of the embodiment of FIG. 1.

Referring to FIG. 3, depicted is a schematic block diagram of an exemplary implementation of the embodiment of FIG. 1. The power adapter 102 is coupled to the information handling system 100 through a cable 304 and a connector having contacts 306*a*, 308*a* and 310*a* that mate with an appropriate connector having contacts 306*b*, 308*b* and 310*b* on the information handling system 100. The contacts 306*a*, 308*a* are power connections from the power adapter 102 to the information handling system 100 contacts 306*b*, 308*b*, and the contacts 310*a* and 310*b* form a connection for a control signal from the information handling system 100 to the power adapter 102. As an example, the signal on the contact 310 may be set to a first logic level, e.g., logic zero or ground, when the power adapter 102 and the information handling system 100 are coupled together. Only after the power adapter 102 senses the appropriate first logic level signal from the information handling system 100, will the power adapter 102 present a DC output voltage to the information handling system 100. Thus, no high in-rush current will occur as the contacts of the power connectors mate, thereby insuring that the power adapter 102 power connector properly mates with the power connector of the information handling system 100 before power is applied. In addition, the present invention is specifically adapted to gradually increase the voltage upon detection of the first logic level signal on the contact 310. This allows the filter capacitance of the information handling system 100 to safely and reliable charge up to an operating voltage without component damage due to large in-rush currents.

Figure 3A:
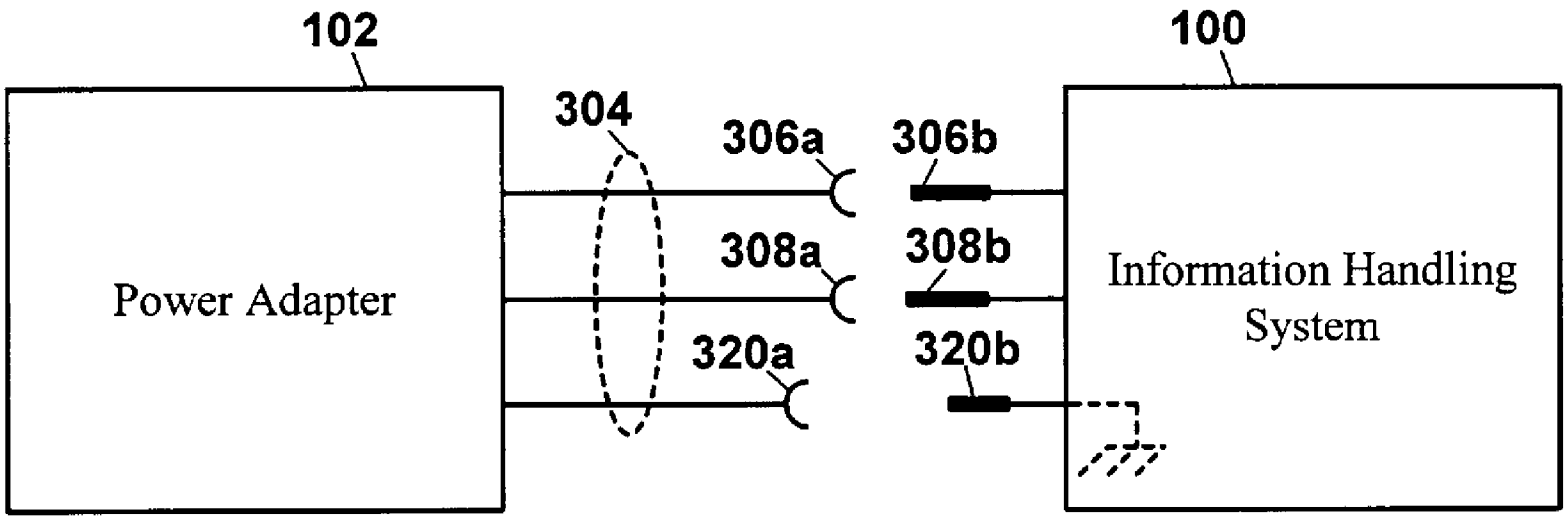
FIG. 3A is a schematic diagram of another connector according to an exemplary implementation of the embodiment of FIG. 1.

Referring to FIG. 3A, depicted is a schematic block diagram of another exemplary implementation of the embodiment of FIG. 1. The power adapter 102 is coupled to the information handling system 100 through a cable 304 and a connector having contacts 306*a*, 308*a* and 320*a* that mate with an appropriate connector having contacts 306*b*, 308*b* and 320*b* on the information handling system 100. The contacts 306*a*, 308*a* are power connections from the power adapter 102 to the information handling system 100 contacts 306*b*, 308*b*, and the contacts 320*a* and 320*b* form a connection for a control signal from the information handling system 100 to the power adapter 102. The contacts 320*a* and/or 320*b* may be adapted to make (connect) after the contacts 306 and 308 have fully engaged (connected), and the contacts 320*a* and/or 320*b* will break (disconnect) before the contacts 306 and 308 have disengaged (disconnected). As an example, the signal on the contact 320 may be set to a first logic level, e.g., logic zero or ground, when the power adapter 102 and the information handling system 100 are coupled together. Only after the power adapter 102 senses the first logic level from the information handling system 100, will the power adapter 102 present a DC output voltage to the information handling system 100. Thus, no high in-rush current will occur as the contacts of the power connectors mate, thereby insuring that the power adapter 102 power connector properly mates with the power connector of the information handling system 100 before power is applied. In addition, the present invention is specifically adapted to gradually increase the voltage upon detection of the first logic level on the contact 320. This allows the filter capacitance of the information handling system 100 to safely and reliable charge up to an operating voltage without component damage due to large in-rush currents.

Figure 5:
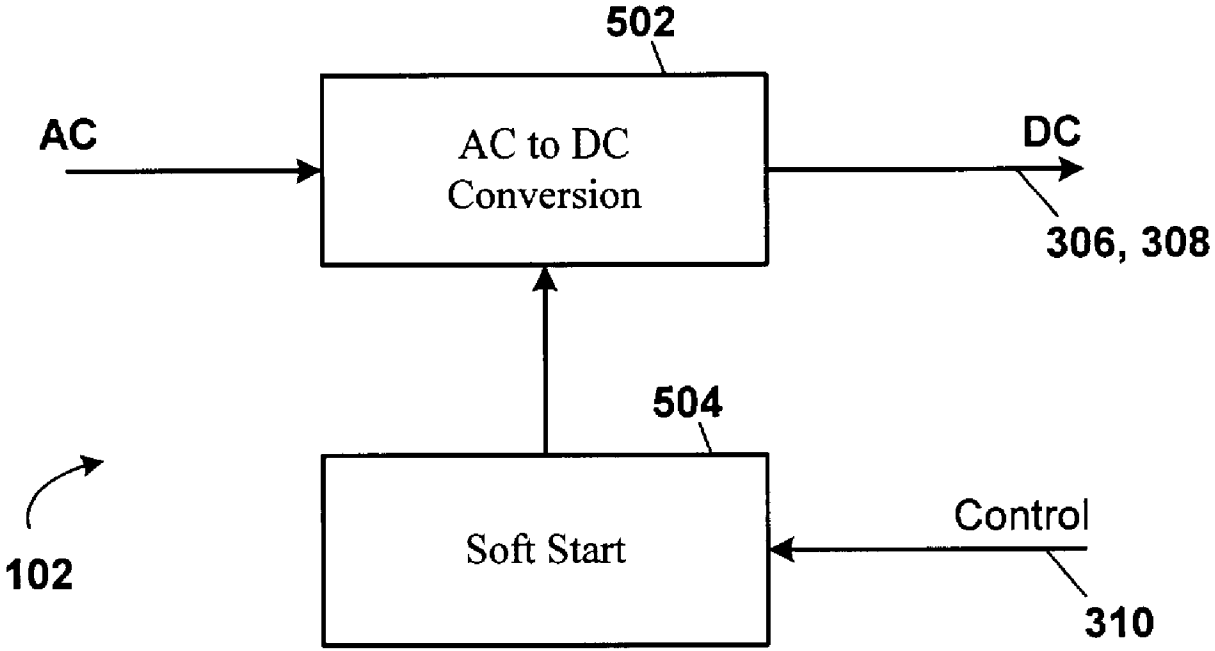
FIG. 5 is a more detailed schematic functional block diagram of the exemplary embodiments of FIGS. 3 and 3A.

FIG. 5 depicts a more detailed schematic block diagram of the exemplary embodiment of FIGS. 3 and 3A. The power adapter 102 comprises an AC to DC conversion circuit 502 and a soft start circuit 504. The soft start circuit 504 controls the AC to DC conversion circuit 502 such that DC voltage at contacts 306, 308 is not present until the first logic level is detected on the control input 310 to the soft start circuit 504. Thereby insuring that the power connector of the power adapter 102 is adequately coupled to the mating power connector of the information handling system 100 before any damaging high in-rush current may occur.

Figure 4:
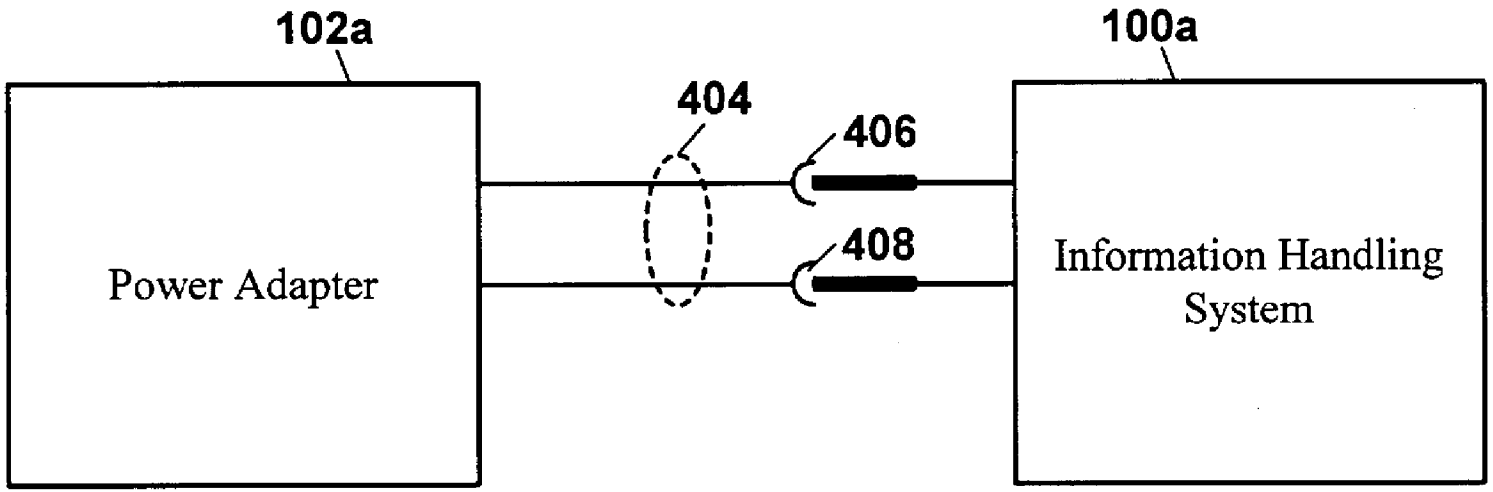
FIG. 4 is a schematic diagram of a connector of another exemplary implementation of the embodiment of FIG. 1.

Referring to FIG. 4, depicted is a schematic block diagram of another exemplary implementation of the embodiment of FIG. 1. The power adapter 102*a* is coupled to the information handling system 100*a* through a cable 404 and a connector having contacts 406 and 408 that mate with an appropriate connector (not shown) on the information handling system 100*a*. The contacts 406, 408 are power connections from the power adapter 102*a* to the information handling system 100*a*. As an example, when the power adapter 102*a* and the information handling system 100*a* are coupled together, the power adapter 102*a* senses an electrical load of the information handling system 100*a*. An advantage of this exemplary embodiment is that power adapters, according to the present invention, may be manufactured for retrofit, replacement and after-market power adapters for legacy information handling systems.

The electrical load may be sensed by the amount of current flow from the power adapter 102*a* to the information handling system 100*a*. The electrical load also may be sensed by measurement of a lower resistance across the contacts 406, 408 compared to when the power adapter 102*a* is not coupled to the information handling system 100*a*. Other and further ways to determine when an electrical load is connected are well known to those having skill in the power supply arts.

Once this load is sensed, the power adapter 102*a* will connect power to the information handling system 100*a*. Thus, no high in-rush current will occur as the contacts of the power connectors mate. Only after the power adapter 102*a* power connector properly mates with the power connector of the information handling system 100*a* will power be applied. In addition, the present invention is specifically adapted to gradually increase the voltage upon detection of the electrical load on the contacts 406, 408. This allows the filter capacitance of the information handling system 100*a* to safely and reliable charge up to an operating voltage without component damage due to large in-rush currents.

Figure 6:
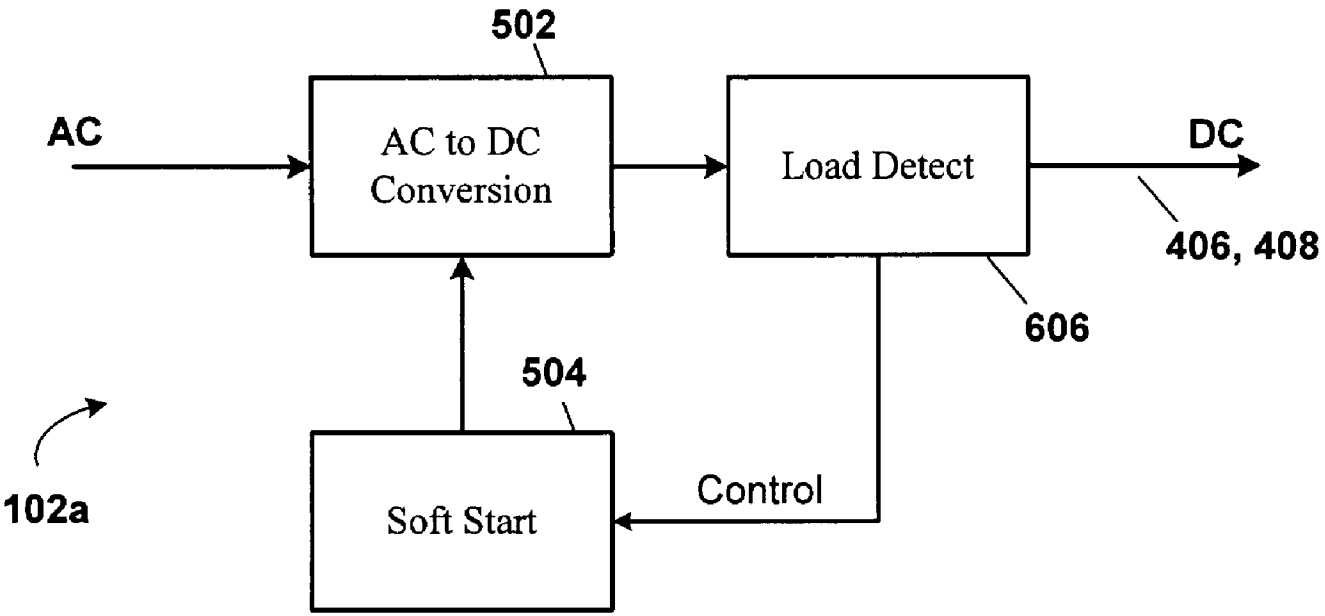
FIG. 6 is a more detailed schematic functional block diagram of the exemplary embodiment of FIG. 4.

FIG. 6 depicts a more detailed schematic block diagram of the exemplary embodiment of FIG. 4. The power adapter 102*a* comprises an AC to DC conversion circuit 502 and a soft start circuit 504. The soft start circuit 504 controls the AC to DC conversion circuit 502 such that DC voltage at contacts 406, 408 is not present until the electrical load is detected by a load detect circuit 606 and a control signal indicating such is sent to the soft start circuit 504. Thereby insuring that the power connector of the power adapter 102*a* is adequately coupled to the mating power connector of the information handling system 100*a* before any damaging high in-rush current may occur.

The invention, therefore, is well adapted to carry out the objects and to attain the ends and advantages mentioned, as well as others inherent therein. While the invention has been depicted, described, and is defined by reference to exemplary embodiments of the invention, such references do not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. An information handling system having an external power adapter, said system comprising:

an information handling system having an input power connector, the input power connector having first power contacts and a first control signal contact;

an external power adapter having an output power connector, the output power connector having second power contacts and a second control signal contact, wherein the first and second power contacts are substantially connected together before the first and second control signal contacts connect together; and a voltage control circuit for controlling an output voltage from the external power adapter, wherein there is substantially no output voltage until the voltage control circuit senses the connection of the first and second control signal contacts.

2. The information handling system according to claim 1, wherein a first logic level is generated when the voltage control circuit senses the connection of the first and second control signal contacts.

3. The information handling system according to claim 2, wherein the first logic level is a logic zero.

4. The information handling system according to claim 2, wherein the first logic level is at substantially a power supply common voltage level.

5. The information handling system according to claim 1, wherein the first and second control signal contacts disconnect before the first and second power contacts disconnect.

6. The information handling system according to claim 1, further comprising a soft start circuit for increasing the output voltage over a period of time after the voltage control circuit senses the connection of the first and second control signal contacts.

7. An external power adapter for an information handling system, comprising:

an external power adapter having an output power connector adapted for coupling to an input power connector of an information handling system, the output power connector and input power connector each have mating power contacts and a control signal contact, wherein the power contacts are substantially connected together before the control signal contacts connect together; and a voltage control circuit for controlling an output voltage from the external power adapter, wherein there is substantially no output voltage until the voltage control circuit senses the connection of the control signal contacts.

8. The external power adapter according to claim 7, further comprising a soft start circuit for increasing the output voltage over a period of time after the voltage control circuit senses the connection of the control signal contacts.

9. The external power adapter according to claim 7, wherein a first logic level is generated when the voltage control circuit senses the connection of the control signal contacts.

10. A method of soft power-up for an external power adapter, said method comprising: connecting together power contacts between an external power adapter and an input power connector of an information handling system before engaging a connecting control signal contacts therebetween; and controlling an output voltage from the external power adapter so that there is substantially no output voltage until the control signal contacts are connected together.

11. The method according to claim 10, further comprising the step of increasing the output voltage over a period of time after the control signal contacts are connected together.

* * * * *